US011459648B2

(12) United States Patent
Fan et al.

(10) Patent No.: US 11,459,648 B2
(45) Date of Patent: Oct. 4, 2022

(54) PERFORMANCE CONTROLLING METHOD FOR HIGH-STRENGTH ALUMINUM ALLOY SHELL DURING ULTRA-LOW TEMPERATURE FORMING PROCESS

(71) Applicant: Dalian University of Technology, Liaoning (CN)

(72) Inventors: Xiaobo Fan, Dalian (CN); Shijian Yuan, Dalian (CN); Zhubin He, Dalian (CN)

(73) Assignee: Dalian University of Technology, Liaoning (CN)

( * ) Notice: Subject to any disclaimer, the term of this patent is extended or adjusted under 35 U.S.C. 154(b) by 0 days.

(21) Appl. No.: 17/189,229

(22) Filed: Mar. 1, 2021

(65) Prior Publication Data

US 2022/0049334 A1 Feb. 17, 2022

(30) Foreign Application Priority Data

Jul. 15, 2020 (CN) ..... 202010678933.1

(51) Int. Cl.

| | |
|---|---|
| ***C22F 1/04*** | (2006.01) |
| ***C21D 9/46*** | (2006.01) |
| ***C22C 21/00*** | (2006.01) |

(52) U.S. Cl.

CPC ..... *C22F 1/04* (2013.01); *C21D 9/46* (2013.01); *C22C 21/00* (2013.01)

(58) Field of Classification Search

None

See application file for complete search history.

(56) References Cited

FOREIGN PATENT DOCUMENTS

CN 107866491 A 4/2018

OTHER PUBLICATIONS

An Li-Hui, Yuan Shi-Jian, Deformation of 2219 aluminum alloy thin-walled curve parts in stretch forming process, Journal of Materials Engineering, Apr. 2020, pp. 123-130, vol. 18, issue 1, China Academic Journal Electronic Publishing House, China.

*Primary Examiner* — George Wyszomierski
*Assistant Examiner* — Janell C Morillo
(74) *Attorney, Agent, or Firm* — Bochner IP, PLLC; Andrew D. Bochner

(57) ABSTRACT

Provided is a performance controlling method for a high-strength aluminum alloy shell during an ultra-low temperature forming process. The present disclosure greatly improves the performance of an aluminum alloy sheet by applying an ultra-low temperature. The present disclosure cools the aluminum alloy sheet to an ultra-low temperature by using an ultra-low temperature cooling medium, so as to compensate for insufficient hardening caused by insufficient deformation and avoid cracking caused by increased deformation. The present disclosure cools the sheet blank zonally according to a deformation law of a desired curved part, and controls the ultra-low temperature distribution of the sheet blank during forming so as to promote the formation of a substructure in a small-deformation zone. In this way, the present disclosure improves a subsequent age-hardening effect, and corresponding uniformity of microstructure and performance, and effectively solves the problem of non-uniformity due to uneven deformation.

14 Claims, 3 Drawing Sheets

PERFORMANCE CONTROLLING METHOD FOR HIGH-STRENGTH ALUMINUM ALLOY SHELL DURING ULTRA-LOW TEMPERATURE FORMING PROCESS

TECHNICAL FIELD

The present disclosure relates to the technical field of sheet metal forming, in particular to a performance controlling method for a high-strength aluminum alloy shell during an ultra-low temperature forming process.

BACKGROUND

High-strength aluminum alloys, such as 2000 series, 7000 series, Al—Li and other heat-treatable aluminum alloys, are widely used as the main structural material in the aviation and aerospace fields, due to their high specific strength, high rigidity and excellent corrosion resistance. As the key structure of aerospace vehicles, skin-like shells such as aircraft cabin and rocket tank dome shell are also the important parts in aerodynamic configuration and major load-bearing structural parts. In order to meet the development needs of lightweight and high reliability of the new generation aircraft, the aluminum alloy skin-like shells have increasingly higher requirements for mechanical performance.

The balance of mechanical performance with shape accuracy is a difficulty for the manufacture of the high-strength aluminum alloy shell. The heat-treatable aluminum alloy must go through solution and aging treatments to have a required high strength. However, although the solution and age-hardened aluminum alloy has high strength, its plasticity is greatly reduced, making it prone to cracking and hard to form a complex shell part. If the complex shell part is formed in an annealed state (soft state) of the aluminum alloy before solution treatment, great shape distortion will be caused during subsequent quenching process. The current technical route for manufacturing the aluminum alloy shell is solution treatment (semi-hard state), rapid transfer, forming and artificial aging. The existing forming processes are mainly stretch forming and deep drawing. In stretch forming, a tension is applied by gripping jaws to make the sheet metal blank gradually fit to the die to form a part with a desirable shape. Stretch forming is suited for forming large-sized aluminum alloy shells with small curvature in the aerospace field. However, since the aluminum alloy shell is often asymmetrical in shape, uneven deformation occurs when the sheet blank is gradually fit to the die. A larger fit zone deforms more and a smaller fit zone deforms less. Meanwhile, a first fit zone also deforms less, which is affected by the friction and contact sequence.

As known, the high-strength aluminum alloy needs to be pre-deformed before aging to further promote the dispersion and precipitation of the hardening phase, so as to obtain the best strengthening effect. The key to this technical route is to control the amount and distribution of deformation. The uneven deformation in the forming process will inevitably lead to poor uniformity in the microstructure and performance of the shell after aging, that is, the small-deformation zone is insufficiently hardened while the large-deformation zone is hardened. In addition, excessive deformation can easily lead to over-aging, resulting in a decrease in the performance of the large-deformation zone. In order to improve the strength of the small-deformation zone, the deformation of the small-deformation zone is usually increased by optimizing the sheet blank or changing the loading path, but this will cause an increase in the deformation of the large-deformation zone or force transmission zone, and even cause cracking.

In summary, the existing technical route is hard to solve the problem of poor uniformity in the microstructure and performance of the formed aluminum alloy skin-like shell. Research has found that the deformation mechanism of the aluminum alloy changes at an ultra-low temperature. Compared with normal temperature deformation, due to multi-system slippage, low temperature deformation with the same degree of deformation will generate more dislocation structures inside the grains, increasing the substructure density and promoting the subsequent age-hardening effect. Therefore, it is urgent to provide a technical route for simultaneously forming a high-strength aluminum alloy shell and controlling performance thereof.

SUMMARY

An objective of the present disclosure is to provide a performance controlling method for a high-strength aluminum alloy shell during an ultra-low temperature forming process. Based on a phenomenon that a substructure density of an aluminum alloy increases during ultra-low temperature forming, the present disclosure solves the problem of non-uniform microstructure and performance of an aluminum alloy shell due to uneven deformation. The present disclosure controls an ultra-low temperature distribution of a sheet during forming, and promotes the formation of a substructure in a small-deformation zone, thereby improving a subsequent age-hardening effect and improving the uniformity of the microstructure and performance.

To achieve the above objective, the present disclosure provides the following solutions: The present disclosure provides a performance controlling method for a high-strength aluminum alloy shell during an ultra-low temperature forming process. The method mainly includes the following steps:

step 1: cooling a special-shaped forming die to an ultra-low temperature lower than 150 K;

step 2: gripping an aluminum alloy sheet to be formed by gripping jaws;

step 3: moving the aluminum alloy sheet downwards to fit to the special-shaped forming die;

cooling the aluminum alloy sheet to below 150 K; stretching the aluminum alloy sheet until a curved part with a desired shape is formed; and step 4: releasing the gripping jaws, taking out the curved part for aging, and completing control of a microstructure and performance of the aluminum alloy curved part.

Optionally, in step 1, a small-deformation zone of the special-shaped forming die is cooled to an ultra-low temperature lower than 150 K according to a deformation distribution law of the curved part.

Optionally, in step 1, the special-shaped forming die is not cooled, but the aluminum alloy sheet in the small-deformation zone is directly cooled by a cold gas to an ultra-low temperature lower than 150 K.

Optionally, in step 1, the special-shaped forming die is uniformly cooled according to the deformation distribution law of the curved part.

Optionally, the aluminum alloy sheet is a rolled sheet with a wall thickness of 0.1-20 mm. Optionally, the shape of the aluminum alloy sheet is optimized according to the deformation law to reduce uneven deformation.

Optionally, the aluminum alloy sheet is heat-treated into a solid solution state or T4 state; the T4 state is a state where a solid solution treatment and a natural aging treatment are sufficiently stable.

Optionally, a set temperature range of the aluminum alloy sheet and the special-shaped forming die is 4-150 K.

Optionally, in step 1, an ultra-low temperature cooling medium used for the special-shaped forming die is one of liquid argon, liquid nitrogen or liquid helium, and the special-shaped forming die has a built-in passage for circulating the cooling medium.

Optionally, in step 2, after the aluminum alloy sheet to be formed is gripped by the gripping jaws, a thermal insulation layer is laid on the sheet.

Optionally, the aluminum alloy sheet is one of Al—Cu alloy, Al—Li alloy, Al—Zn alloy or new high-strength aluminum alloy.

Optionally, the special-shaped forming die rests on a press table, and the special-shaped forming die is provided with a special-shaped surface that is one of a melon petal-shaped curved surface, a conical curved surface, a double-curvature curved surface and a complex special-shaped curved surface.

The performance controlling method for a high-strength aluminum alloy shell during an ultra-low temperature forming process provided by the present disclosure specifically has the following beneficial effects:

(1) The present disclosure promotes the formation of a large number of substructures in the aluminum alloy through ultra-low temperature deformation, improving the age-hardening effect.

(2) The present disclosure cools the sheet zonally according to the deformation law of the curved part (a smaller deformation indicates a lower temperature), reducing non-uniformity in the hardening effect caused by uneven deformation through the ultra-low temperature distribution, improving the uniformity of the microstructure and performance.

(3) The present disclosure compensates for insufficient hardening caused by insufficient deformation through an ultra-low temperature, and avoids the problem of cracking caused by increased deformation.

(4) The present disclosure directly cools the sheet by using a cold gas, avoiding the problem of cooling a large-sized and complex special-shaped forming die.

BRIEF DESCRIPTION OF DRAWINGS

To describe the technical solutions in the embodiments of the present disclosure or in the prior art more clearly, the following briefly describes the accompanying drawings required for describing the embodiments. Apparently, the accompanying drawings in the following description show merely some embodiments of the present disclosure, and a person of ordinary skill in the art may still derive other drawings from these accompanying drawings without creative efforts.

Figure 1:
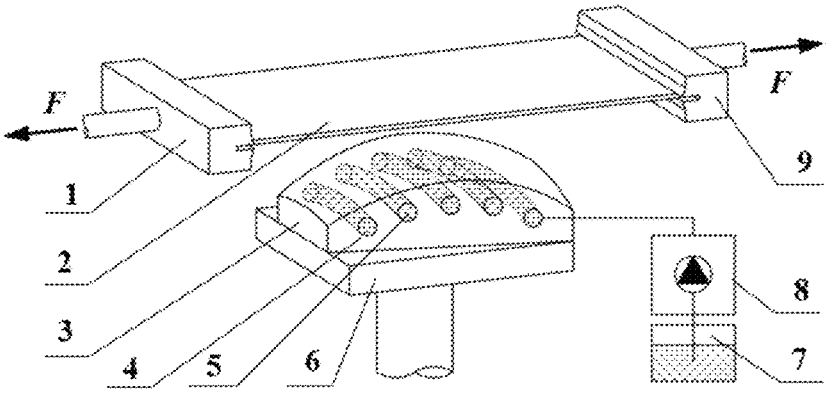
FIG. 1 is a schematic view of structure and cooling of an ultra-low temperature special-shaped forming die according to the present disclosure.

Reference Numerals: 1. left gripping jaw; 2. sheet before forming; 3. melon petal-shaped uniform cooling die; 4. passage; 5. ultra-low temperature cooling medium; 6. press table; 7. low-temperature container; 8. low-temperature pressurizer; 9. right gripping jaw; 10. sheet after forming; 11. melon petal-shaped zonal cooling die; 12. sheet under forming; 13. left cooling nozzle; 14. right cooling nozzle; and 15. thermal insulation layer.

DETAILED DESCRIPTION

The technical solutions of the embodiments of the present disclosure are clearly and completely described below with reference to the accompanying drawings. Apparently, the described embodiments are only illustrative ones, and are not all possible ones of the present disclosure. All other embodiments derived from the embodiments of the present disclosure by a person of ordinary skill in the art without creative efforts should fall within the protection scope of the present disclosure.

To make the above objectives, features and advantages of the present disclosure clearer and more comprehensible, the present disclosure is described in further detail below with reference to the accompanying drawings and specific implementations.

Embodiment 1

Figure 2:
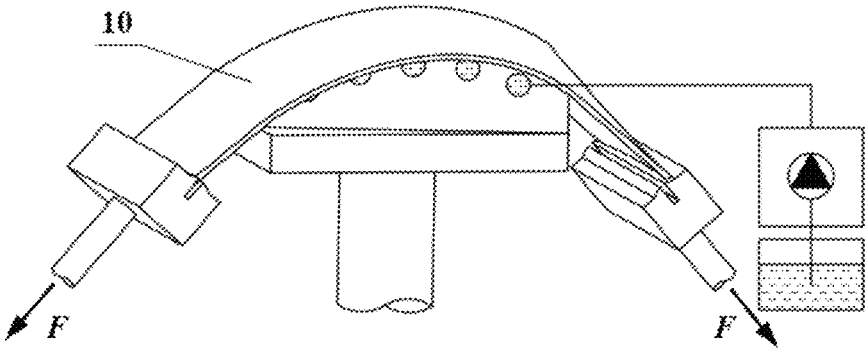
FIG. 2 is a schematic view of structure and cooling of the die during forming of a sheet according to the present disclosure.

As shown in FIGS. 1 and 2, this embodiment provides a method for forming an aluminum alloy double-curvature curved part at an ultra-low temperature by controlling performance thereof. The method is based on a phenomenon that a substructure density of an aluminum alloy sheet increases during ultra-low temperature forming. A melon petal-shaped uniform cooling die 3 is cooled through an ultra-low temperature cooling medium 5. A left gripping jaw 1 and a right gripping jaw 9 simultaneously move downwards and opposite to each other, so that a sheet 2 before forming fits to a die surface to form a melon petal-shaped curved part. The sheet 2 before forming is preferably a solid-solution state 2195 aluminum alloy sheet, with a thickness of 3 mm, a length of 800 mm and a width of 400 mm. As shown in FIG. 1, the melon petal-shaped uniform cooling die 3 rests on a press table 6, and is provided with an ellipsoidal surface, with a long semi-axis length of 550 mm and a short semi-axis length of 390 mm. A plurality of passages 4 are evenly arranged in the melon petal-shaped uniform cooling die 3. A low-temperature container 7 contains liquid nitrogen, which is introduced into the passage 4 through a low-temperature pressurizer 8 to uniformly cool the surface of the melon petal-shaped uniform cooling die 3. This method specifically includes the following steps:

S1: Cool the melon petal-shaped uniform cooling die 3 to an ultra-low temperature lower than 123 K by using liquid nitrogen as the ultra-low temperature cooling medium 5.

S2: Grip two ends of a solution-treated room temperature sheet, that is, the sheet 2 before forming, by the left gripping jaw 1 and the right gripping jaw 9 respectively.

S3: Enable the left gripping jaw 1 and the right gripping jaw 9 to move downwards and opposite to each other at the same time to make the sheet gradually fit to the die surface, cool a deformation zone of the sheet to an ultra-low temperature of 123 K, and stretch the sheet into the shape of the die surface.

S4: Release the gripping jaws, take out the sheet 10 after forming for aging, and complete control of a microstructure and performance of the aluminum alloy curved part at an ultra-low temperature.

In this embodiment, the die surface may also be a conical curved surface, a double-curvature curved surface or a complex special-shaped curved surface, and the liquid nitrogen may be replaced by liquid argon or liquid helium.

Figure 5:
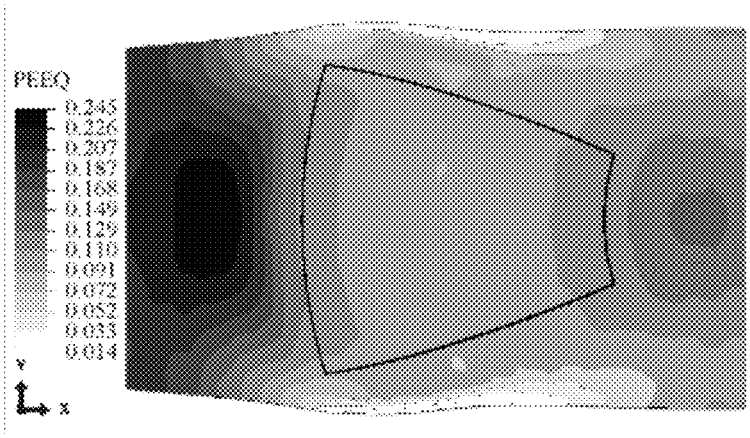
FIG. 5 shows an equivalent strain distribution according to the present disclosure.

FIG. 5 shows an equivalent strain distribution.

It can be seen that the forming method of this embodiment greatly improves the performance of the aluminum alloy sheet formed at an ultra-low temperature. The embodiment cools the aluminum alloy sheet to an ultra-low temperature through an ultra-low temperature cooling medium for forming, improving the substructure density of the aluminum alloy material, and further improving the subsequent age-hardening effect.

Embodiment 2

Figure 3:
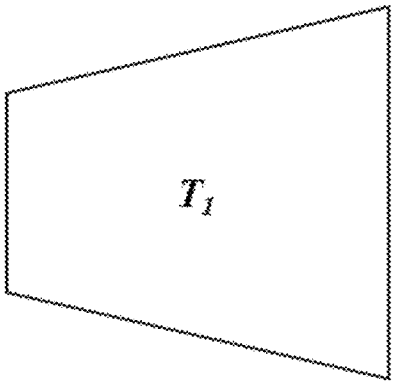
FIG. 3 shows a temperature distribution according to the present disclosure.
Figure 6:
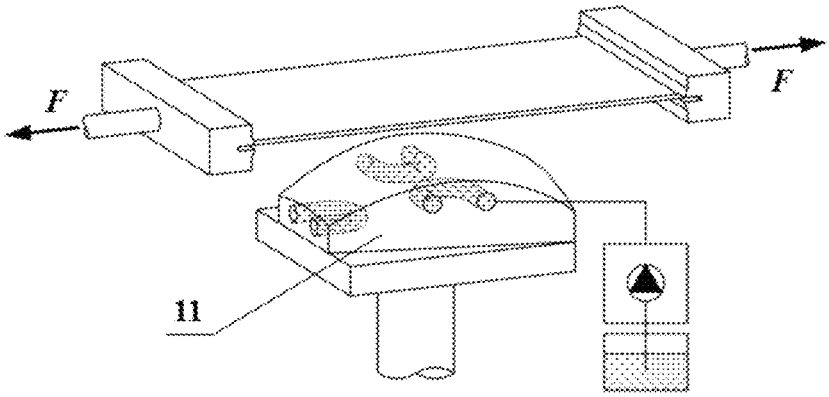
FIG. 6 is a schematic view of structure and cooling of a zonal cooling die according to the present disclosure.
Figure 7:
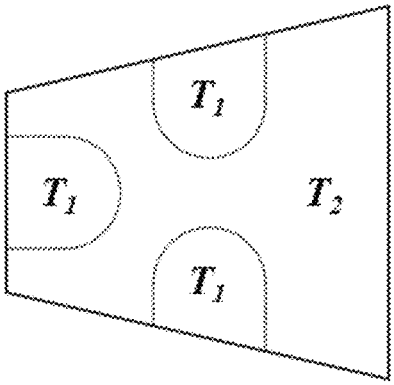
FIG. 7 shows ultra-low temperature zones according to the present disclosure.

As shown in FIGS. 3, 6 and 7, this embodiment provides a method for forming an aluminum alloy double-curvature curved part at an ultra-low temperature by controlling performance thereof. The method is based on a phenomenon that a substructure density of an aluminum alloy sheet increases during ultra-low temperature forming. A melon petal-shaped zonal cooling die 11 is cooled through an ultra-low temperature cooling medium 5. A left gripping jaw 1 and a right gripping jaw 9 simultaneously move downwards and opposite to each other, so that a sheet 2 before forming fits to a die surface to form a complex curved part. The sheet 2 before forming is preferably a solid-solution state 2195 aluminum alloy sheet, with a thickness of 15 mm, a length of 3,300 mm and a width of 1,600 mm. The melon petal-shaped zonal cooling die 11 rests on a press table 6, and is provided with an ellipsoidal surface, with a long semi-axis length of 2,200 mm and a short semi-axis length of 1,570 mm. When this die surface is used for forming, a right wide zone has a larger amount of deformation, and a left narrow zone and front and back zones have a smaller amount of deformation. As shown in FIG. 7, the front and back zones are direct cooling zones with temperature T1; the other zones will not be cooled and have temperature T2, T1< T2. The melon petal-shaped zonal cooling die 11 is provided therein with curved passages 4, as shown in FIG. 6. This method specifically includes the following steps:

S1: Cool the melon petal-shaped zonal cooling die 11 to an ultra-low temperature lower than 123 K to form these temperature zones by using liquid nitrogen as the ultra-low temperature cooling medium 5.

S2: Grip two ends of a solution-treated room temperature sheet, that is, the sheet 2 before forming, by the left gripping jaw 1 and the right gripping jaw 9 respectively.

S3: Enable the left gripping jaw 1 and the right gripping jaw 9 to move downwards and opposite to each other at the same time to make the sheet gradually fit to the die surface; cool front, back and left deformation zones of the sheet to an ultra-low temperature of 123 K, and naturally cool other zones with the die; stretch the sheet into the shape of the die surface.

S4: Release the gripping jaws, take out the sheet 10 after forming for aging, and complete control of a microstructure and performance of the aluminum alloy curved part at an ultra-low temperature.

In this embodiment, the die surface may also be a conical curved surface, a double-curvature curved surface or a complex special-shaped curved surface, and the liquid nitrogen may be replaced by liquid argon or liquid helium.

The forming method of this embodiment cools the sheet zonally according to the deformation distribution of the die surface. It cools a small-deformation zone rather than a large-deformation zone, which compensates for an insufficient substructure density of the small-deformation zone, and improves uniformity in the hardening effect of the large and small-deformation zones of the formed part. The ultra-low temperature forming method adjusts the substructure density indirectly through temperature control, and avoids the problem of excessive deformation and even cracking in the large-deformation zone caused by direct deformation control.

Embodiment 3

Figure 4:
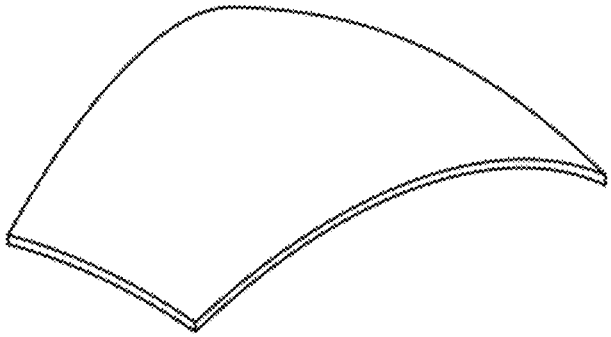
FIG. 4 is a structural view of a melon petal-shaped curved part according to the present disclosure.
Figure 8:
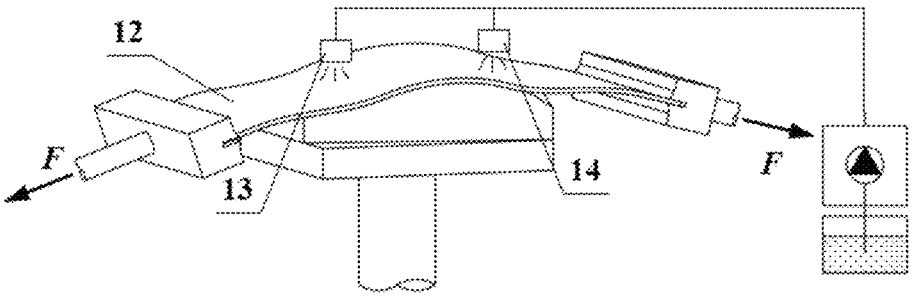
FIG. 8 shows a sheet directly cooled by using a cold gas according to the present disclosure.

As shown in FIGS. 4 and 8, this embodiment provides a method for forming an aluminum alloy double-curvature curved part at an ultra-low temperature by controlling performance thereof. The method is based on a phenomenon that a substructure density of an aluminum alloy sheet increases during ultra-low temperature forming. A left cooling nozzle 13 and a right cooling nozzle 14 spray a gaseous ultra-low temperature cooling medium to directly cool a sheet 12 under forming. A left gripping jaw 1 and a right gripping jaw 9 simultaneously move downwards and opposite to each other, so that the sheet 12 under forming fits to a die surface to form a complex curved part. The sheet 12 under forming is preferably a solid-solution state 2195 aluminum alloy sheet, with a thickness of 20 mm, a length of 5,000 mm and a width of 2,500 mm. A corresponding special-shaped forming die rests on a press table 6, and is provided with an ellipsoidal surface, with a long semi-axis length of 3,500 mm and a short semi-axis length of 2,400 mm. The left cooling nozzle 13 and the right cooling nozzle 14 respectively cool a sheet zone that is about to fit to the special-shaped forming die (that is about to be deformed). As the stretching process progresses, the cooled zone moves from the middle of the sheet to both sides thereof. This method specifically includes the following steps:

S1: Grip two ends of a solution-treated room temperature sheet by the left gripping jaw 1 and the right gripping jaw 9 respectively.

S2: Enable the left gripping jaw 1 and the right gripping jaw 9 to move downwards and opposite to each other at the same time to make the sheet gradually fit to the die surface; move the left cooling nozzle 13 and the right cooling nozzle 14 from the middle of the sheet to both sides thereof to cool a zone to be deformed, so as to improve a substructure density of the zone; stretch the sheet into the shape of the die surface.

S3: Release the gripping jaws, take out a sheet 10 after forming for aging, and complete control of a microstructure and performance of the aluminum alloy curved part at an ultra-low temperature.

In this embodiment, the die surface may also be a conical curved surface, a double-curvature curved surface or a complex special-shaped curved surface, and the liquid nitrogen may be replaced by liquid argon or liquid helium.

Embodiment 4

Figure 9:
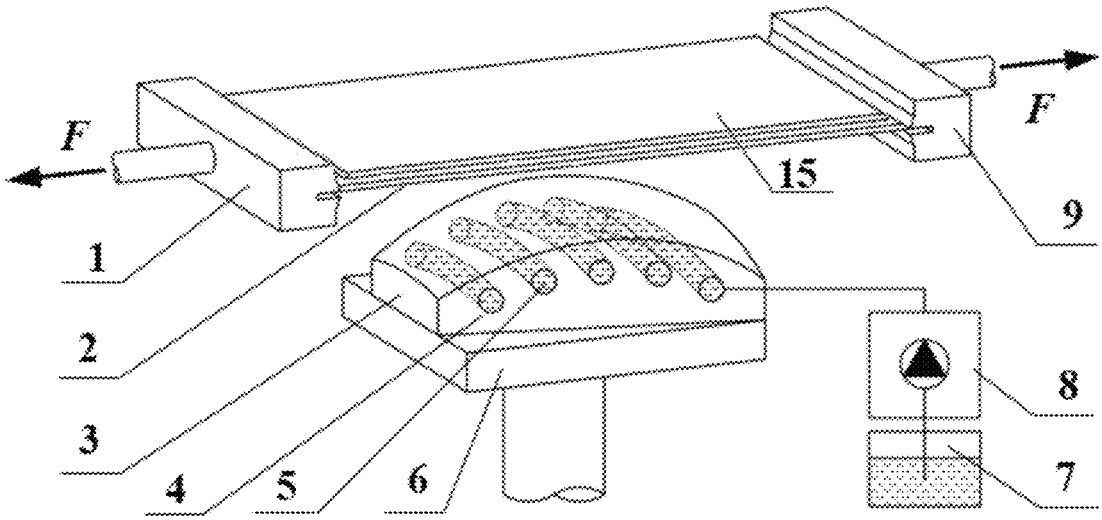
FIG. 9 shows a thermal insulation layer laid on a sheet according to the present disclosure.

As shown in FIG. 9, an aluminum alloy sheet is to be formed into a shell, for example, one with a thickness of less than 5 mm, or the sheet to be formed needs to be cooled to an ultra-low temperature, such as below 100 K. The sheet to be formed is gripped by a left gripping jaw 1 and a right gripping jaw 9, and then a thermal insulation layer 15 is laid on the sheet. The thermal insulation layer prevents the temperature of the sheet from changing during deformation, so as to achieve a cold thermal insulation effect for forming the sheet. The thermal insulation layer 15 is an existing thermal insulation cotton structure, which will not be repeated here.

The forming method of this embodiment cools the sheet blank zonally according to the deformation distribution of the die surface. It cools a small-deformation zone rather than a large-deformation zone, which compensates for an insufficient substructure density of the small-deformation zone, and improves uniformity in the hardening effect of the large and small-deformation zones of the formed part. The ultra-low temperature forming method controls the substructure density indirectly through temperature control, and avoids the problem of excessive deformation and even cracking in the large-deformation zone caused by direct deformation control. Meanwhile, in the ultra-low temperature forming method, when forming a small-sized curved part, the sheet blank is indirectly cooled by cooling the die; when forming a large-sized curved part, the sheet blank is directly cooled, thus avoiding the difficulty in cooling a large-sized die.

It should be noted that it is obvious to those skilled in the art that the present disclosure is not limited to the details of the above exemplary embodiments, and that the present disclosure may be implemented in other specific forms without departing from the spirit or basic features of the present disclosure. Therefore, the embodiments should be regarded as exemplary and non-limiting in every respect, and the scope of the present disclosure is defined by the appended claims rather than the above description, and all changes falling within the meaning and scope of equivalent elements of the claims should be included in the present disclosure, and any reference numbers in the claims should not be construed as a limitation to the claims involved.

Specific embodiments are used for illustration of the principles and implementations of the present disclosure. The description of the embodiments is only used to help illustrate the method and its core ideas of the present disclosure. In addition, persons of ordinary skill in the art can make various modifications in terms of specific embodiments and scope of application in accordance with the teachings of the present disclosure. In conclusion, the content of the present specification should not be construed as a limitation to the present disclosure.

What is claimed is:

1. A performance controlling method for a high strength an aluminum alloy shell during an ultra-low temperature forming process, comprising the following steps:

step 1: locally cooling a small-deformation zone of a special-shaped forming die to an ultra-low temperature lower than 150 K according to a deformation distribution law of a curved part, wherein the aluminum alloy shell is asymmetrical in shape, such that uneven deformation occurs when the aluminum alloy sheet to be formed is gradually fit to a die, and a larger fit zone of the aluminum alloy sheet to be formed deforms more and the smaller fit zone of the aluminum alloy sheet to be formed deforms less; wherein the small-deformation zone of the special-shaped forming die corresponds to a smaller fit zone of the aluminum alloy sheet to be formed; wherein the special-shaped forming die is provided with a melon petal-shaped curved surface, a conical curved surface or a double-curvature curved surface;

step 2: gripping an aluminum alloy sheet to be formed by gripping jaws;

step 3: moving the aluminum alloy sheet downwards to fit to the special-shaped forming die; cooling the aluminum alloy sheet in the small-deformation zone to below 150 K, and stretching the aluminum alloy sheet until a curved part with a desired shape is formed;

step 4: releasing the gripping jaws, taking out the curved part for aging, thereby completing control of a microstructure and performance of the aluminum alloy curved part, to obtain the aluminum alloy shell with the aluminum alloy curved part.

2. The performance controlling method for an aluminum alloy shell during an ultra-low temperature forming process according to claim 1, wherein the aluminum alloy sheet is a rolled sheet with a wall thickness of 0.1-20 mm.

3. The performance controlling method for an aluminum alloy shell during an ultra-low temperature forming process according to claim 1, wherein the aluminum alloy sheet is heat-treated into a solid solution state or T4 state.

4. The performance controlling method for an aluminum alloy shell during an ultra-low temperature forming process according to claim 1, wherein a set temperature range of the aluminum alloy sheet and the special-shaped forming die is 4-150 K.

5. The performance controlling method for an aluminum alloy shell during an ultra-low temperature forming process according to claim 1, wherein in step 1, an ultra-low temperature cooling medium used for the special-shaped forming die is one of liquid argon, liquid nitrogen or liquid helium, and the special-shaped forming die has a built-in passage for circulating the cooling medium.

6. The performance controlling method for an aluminum alloy shell during an ultra-low temperature forming process according to claim 1, wherein in step 2, after the small-deformation zone of the special-shaped forming die is locally cooled and the aluminum alloy sheet to be formed is gripped by the gripping jaws, a thermal insulation layer is laid on the sheet.

7. The performance controlling method for an aluminum alloy shell during an ultra-low temperature forming process according to claim 1, wherein the special-shaped forming die rests on a press table.

8. A performance controlling method for an aluminum alloy shell during an ultra-low temperature forming process, comprising the following steps:

step 1: locally cooling a small-deformation zone of a special-shaped forming die to an ultra-low temperature lower than 150 K according to a deformation distribution law of a curved part, wherein the aluminum alloy shell is asymmetrical in shape, such that uneven deformation occurs when the aluminum alloy sheet to be formed is gradually fit to a die, and a larger fit zone of the aluminum alloy sheet to be formed deforms more and the smaller fit zone of the aluminum alloy sheet to be formed deforms less; wherein the small-deformation zone of the special-shaped forming die corresponds to a smaller fit zone of the aluminum alloy sheet to be formed; wherein the special-shaped forming die is provided with a melon petal-shaped curved surface, a conical curved surface or a double-curvature curved surface;

step 2: gripping an aluminum alloy sheet to be formed by gripping jaws;

step 3: not cooling the special-shaped forming die, moving the aluminum alloy sheet downwards to fit to the special-shaped forming die, directly cooling the aluminum alloy sheet in the small-deformation zone to below 150 K with a cold gas, and stretching the aluminum alloy sheet until the curved part with a desired shape is formed; and step 4: releasing the gripping jaws, taking out the curved part for aging, thereby completing control of a microstructure and performance of the aluminum alloy curved part, to obtain the aluminum alloy shell with the aluminum alloy curved part.

9. The performance controlling method for an aluminum alloy shell during an ultra-low temperature forming process according to claim 8, wherein the aluminum alloy sheet is a rolled sheet with a wall thickness of 0.1-20 mm.

10. The performance controlling method for an aluminum alloy shell during an ultra-low temperature forming process according to claim 8, wherein the aluminum alloy sheet is heat-treated into a solid solution state or T4 state.

11. The performance controlling method for an aluminum alloy shell during an ultra-low temperature forming process according to claim 8, wherein a set temperature range of the aluminum alloy sheet and the special-shaped forming die is 4-150 K.

12. The performance controlling method for an aluminum alloy shell during an ultra-low temperature forming process according to claim 8, wherein in step 1, an ultra-low temperature cooling medium used for the special-shaped forming die is one of liquid argon, liquid nitrogen or liquid helium, and the special-shaped forming die has a built-in passage for circulating the cooling medium.

13. The performance controlling method for an aluminum alloy shell during an ultra-low temperature forming process according to claim 8, wherein in step 2, after the small-deformation zone of the special-shaped forming die is locally cooled and the aluminum alloy sheet to be formed is gripped by the gripping jaws, a thermal insulation layer is laid on the sheet.

14. The performance controlling method for an aluminum alloy shell during an ultra-low temperature forming process according to claim 8, wherein the special-shaped forming die rests on a press table.

* * * * *